US005265927A

United States Patent [19]

Davidson, Jr.

[11] Patent Number: 5,265,927

[45] Date of Patent: Nov. 30, 1993

[54] DOWNHOLE FISHING TOOL

[76] Inventor: David R. Davidson, Jr., R.R. #4, Box 46A, Enid, Okla. 73701-9311

[21] Appl. No.: 855,873

[22] Filed: Mar. 23, 1992

[51] Int. Cl.[5] ..... E21B 31/18

[52] U.S. Cl. ..... 294/86.3; 294/86.18; 294/86.2; 294/86.26

[58] Field of Search ..... 294/86.1, 86.12, 86.14, 294/86.17-86.22, 86.26, 86.3-86.34, 102.1, 102.2; 166/98, 99

[56] References Cited

U.S. PATENT DOCUMENTS

| | | | |
|---|---|---|---|
| 1,634,935 | 7/1927 | Donnelly . | |
| 1,745,274 | 1/1930 | Sauls | 294/86.2 |
| 1,754,696 | 4/1930 | Sauls | 294/86.33 |
| 1,787,834 | 1/1931 | O'Bannon . | |
| 1,797,505 | 3/1931 | Jones et al. | 294/86.33 |
| 1,828,938 | 10/1931 | O'Bannon . | |
| 2,114,988 | 4/1938 | Anthony . | |
| 2,123,036 | 7/1938 | Bozeman | 294/86.2 |
| 2,272,529 | 2/1942 | Larson | 294/86.33 |
| 2,275,911 | 3/1942 | Le Bus | 294/86.22 |
| 2,814,523 | 11/1957 | Stohn | 294/86.31 X |
| 3,851,987 | 12/1974 | Jones | 294/86.33 X |
| 3,854,768 | 12/1974 | King, Sr. . | |
| 4,548,437 | 10/1985 | Driskill | 294/86.33 X |
| 4,945,985 | 8/1990 | Lynds | 166/98 |

*Primary Examiner*—Johnny D. Cherry

*Attorney, Agent, or Firm*—Dougherty, Hessin, Beavers & Gilbert

[57] ABSTRACT

A sucker rod coupling retrieval tool which includes a cylindrical slip bowl having an axially offset cylindrical bore in one end. The opposite end is threaded onto the lower end of a top sub which defines an internal bore receiving an annular bearing. A slip guide carrying a toothed spacer is slidably positioned in the slip bowl below the bearing. The slip guide has an axially offset cylindrical external surface which receives the upper portion of the internal offset cylindrical surface of a tubular slip and guides the slip in relative rotating movement within the slip bowl during operation of the tool. Teeth on the lower end of the spacer function to engage the upper end of the coupling to be retrieved which is also circumferentially gripped by rotating the slip bowl relative to the slip after extending both downwardly over the coupling.

6 Claims, 2 Drawing Sheets

DOWNHOLE FISHING TOOL

1. Field of the Invention

The present invention relates to a downhole fishing tool for removing a sucker rod coupling by disconnection from a threadedly engaged sucker rod string therebelow.

BACKGROUND OF THE INVENTION

2. Brief Description of the Prior Art

Many tools have been manufactured and used for the purpose of fishing objects out of a well bore where such objects constitute an obstruction or hindrance to optimization of drilling for, or the production of, oil and gas. In general, such tools are first lowered to a point in the well bore at which the structure to be retrieved is located. The tool is then engaged with the object by rotating and/or reciprocating the extended tool string which has been lowered into the well bore and carries the tool on its lower end. The tool string is then retracted, thereby raising the engaged object to the surface.

One problem which requires a downhole retrieval of this general type occurs in the case of an oil well being produced by means of a sucker rod reciprocating pump. What occurs is that one of the couplings employed to interconnect the serially aligned sucker rod section either breaks at some location between the two sucker rods, or becomes unscrewed from the next upwardly located sucker rod section and is thus left in the well threaded on the upper end of the next lower section of sucker rod. In either case, retrieval of the sucker rod coupling must be effected in order to permit additional repairs to be completed, and production from the well to be resumed.

In U.S. Pat. No. 1,634,935 issued to Donnelly on Jul. 5, 1927, a tool for elevating sucker rod pipes and the like which have become detached and are located in a well is illustrated and described. This tool comprises a grab formed by two arms which extend downwardly into the well. The grab engages the sucker rod below the box so that the rod can be pulled upwardly out of the well.

U.S. Pat. No. 1,787,834 issued to O'Bannon on Jan. 6, 1931, illustrates and describes a fishing tool in which a sucker rod socket is provided on the lower end of the tool string, and which includes in the socket, a slip unit composed of a plurality of sections which can be actuated from the surface to engage a sucker rod and permit its removal from the well.

U.S. Pat. No. 1,828,938 issued to O'Bannon on Oct. 27, 1931, shows a combination sucker rod socket which includes both primary and secondary slip units supported within a cylindrical body. The slip units are movably seated in tapered seats provided on the inside of the bore and function to engage a sucker rod to be removed from the well.

A downhole tool is described in U.S. Pat. No. 2,114,988 issued to Anthony on Apr. 19, 1938. A slip socket is provided in the tool which socket includes a cylindrical barrel portion having a downwardly tapering inner bore. Teeth are provided for gripping the broken end of the sucker rod and allowing it to be extricated from the hole.

U.S. Pat. No. 3,854,768 to King, Sr., discloses a device for pulling a pipe out of a well bore. The device includes a tubular housing which has a tapered internal bore, the diameter of which becomes more restricted or diminished in the direction of the lower end of the tool, or, stated differently, in a downhole direction. A longitudinally slotted holding member is disposed within this tapered bore and is first pushed against a boss disposed at the closed end of the housing until the slot is expanded and the internal end of the holding member is engaged on the boss with the holding member thus expanded. The pipe to be gripped is inserted into the center of the slotted holding member. The holding member is then pulled away from, or off of, the boss so that the slot retracts. This allows the holding member to converge and grip the pipe so that it can be removed.

A downhole retrieval tool is described in U.S. Pat. No. 4,945,985. This tool includes a rectangular plate which has a notch at one end, and it is lowered into a well casing so that the notch end is used to engage a pipe coupling for lifting the coupling out of the casing.

BRIEF DESCRIPTION OF THE PRESENT INVENTION

The present invention provides a downhole fishing tool which facilitates the removal of structure such as a sucker rod coupling which is in tact but unscrewed from the upper portion of the sucker rod string so that the top side of the coupling is exposed, or, is parted at a location intermediate the length of the coupling. The tool functions by first engaging the upper end of the coupling to be extricated to prevent rotative movement relative to the surrounding production tubing and relative to portions of the tool then extended over the coupling. The tool is then rotated so as to constrict relatively rotated parts of the tool about the outer side of the coupling, and to thereby firmly circumferentially grip and engage the coupling preparatory to unscrewing the coupling from the upper end of a sucker rod section to which it is threaded. The unthreading of the coupling from this section of sucker rod is effected by further rotation of the string which carries the fishing tool on the lower end thereof.

Broadly described, the tool of the invention is mounted on the lower end of an elongated tool string to which the tool is connected by a counterclockwise thread carried on the end of a generally cylindrical top sub forming a part of the tool. The top sub has a lower end which is counterbored to receive a bearing element. A tubular slip bowl having an upper end portion internally threaded to engage the lower end of the top sub has an axially offset cylindrical bore in the lower end thereof. This cylindrical bore is offset from the longitudinal axes of the slip bowl, and of the generally cylindrical top sub to which the slip bowl is connected as described.

An elongated tubular slip is positioned within the slip bowl and is rotatable relative to the slip bowl during operation of the tool. This slip also has an axially offset bore extending upwardly thereinto from the lower end of the slip so that the direction of axial offset of the bore in the slip can be caused to vary from 0° degrees to 180° from the direction of axial offset of the cylindrical bore of the slip bowl with such variation in the direction of the offset being caused by rotation of the slip bowl about the slip during operation of the fishing tool.

The tool further includes a cylindrical slip guide element which is connected to the slip for rotation therewith, and which carries at its lower end, a spacer element which is of a selected length. The spacer element is detachably engaged with the slip guide element and projects downwardly therefrom. The spacer element is characterized further in including axially projecting teeth or friction elements on the lower end thereof adapted, in either case, for engagement with the structure to be extricated from the well by the use of the fishing tool.

The fishing tool is specifically adapted for engagement with a coupling of the type used to interconnect sections of sucker rod. The tool is operated by first engaging with the teeth or friction elements the structure to be removed from the well, and then rotating the slip bowl relative to the slip through the instrumentality of the tool string which extends to the surface. This rotation of the slip bowl relative to the slip causes the coupling or other structure extending upwardly within the slip to be gripped between the slip and slip bowl. Further rotation of the string will then uncouple or unscrew the coupling or the structure from a string to which it is threadedly connected, and facilitate the removal of the coupling, or other structure, with the string and fishing tool when they are removed from the well bore.

An important object of the invention is to provide a downhole fishing tool which can be easily engaged with a sucker rod coupling which has, either through fracturing or unintentional unthreading, become disengaged from a sucker rod string ascending upwardly therefrom so that the coupling remains in the hole in threaded engagement only with the portion of the string which extends downwardly therefrom.

Another object of the invention is to provide an easily used downhole fishing tool which can be employed for engaging a fractured or unthreaded sucker rod coupling, and used to unthread and remove the coupling by the simple surface control movements of a downward jarring movement, followed by an unthreading rotation of the string carrying the tool, followed by upward retraction of both the fishing tool and the sucker rod coupling engaged thereby.

An additional object of the invention is to provide a downhole fishing tool which can be used for removing a sucker rod coupling from a downhole environment, which fishing tool has relatively few moving parts each of simple construction, and is further characterized in having a long and trouble free operating life.

Other objects and advantages of the invention will become apparent as the following detailed description of the invention is read in conjunction with the accompanying drawings which illustrate a preferred embodiment of the invention.

GENERAL DESCRIPTION OF THE DRAWINGS

DETAILED DESCRIPTION OF A PREFERRED EMBODIMENT OF THE INVENTION

Figure 1:
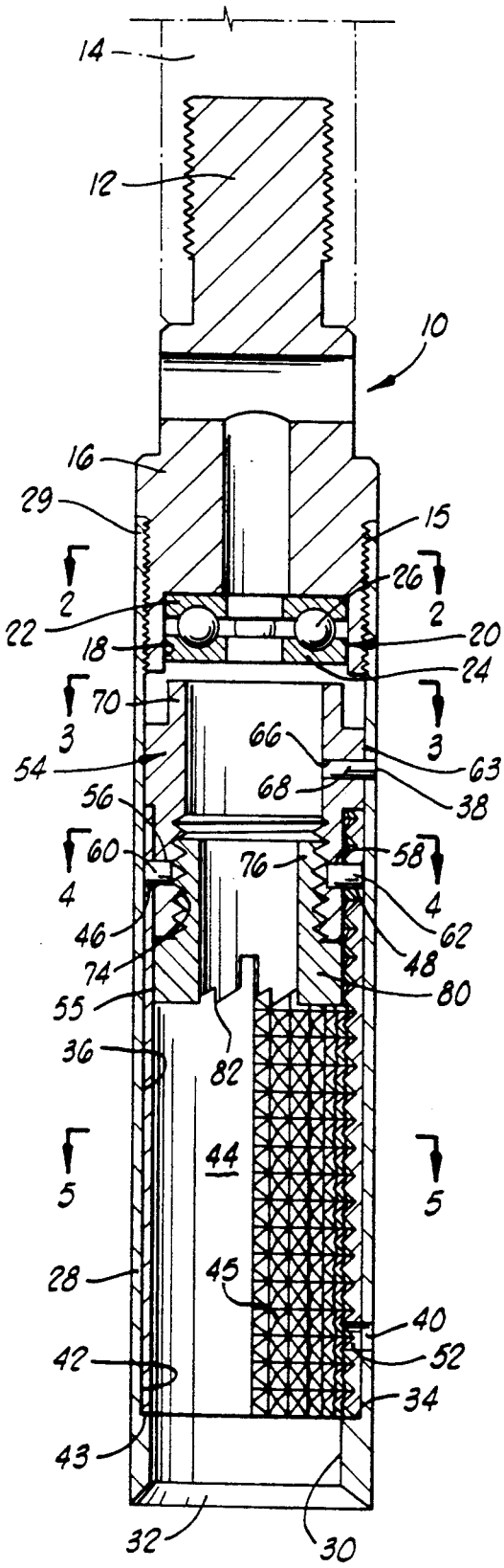
FIG. 1 is a vertical sectional view taken in a plane containing the vertical center line of the downhole tool of the invention. The tool string to which the fishing tool is connected is illustrated in dashed lines in FIG. i.
Figure 2:
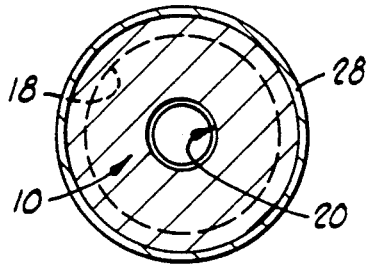
FIG. 2 is a sectional view taken along line 2—2 of FIG. 1.
Figure 3:
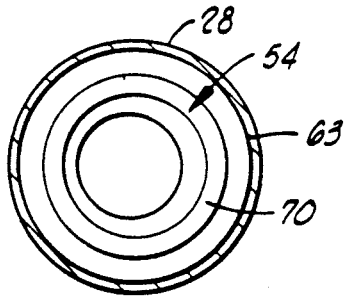
FIG. 3 is a sectional view taken along line 3—3 of FIG. 1.

The fishing tool of the invention includes a top sub 10 which carries a threaded neck 12 at the upper end thereof for engagement with an elongated tool string 14 which extends between the fishing tool and the surface, and which is the instrumentality by which the fishing tool is manipulated and operated by an operator at the surface to accomplish its intended purpose.

The top sub 10 carries an externally threaded cylindrical surface 15 at its lower end, which surface terminates in a radially outwardly projecting shoulder 16. The top sub 10 is provided with a large counterbore 18 in its lower end so that a bearing subassembly 20 can be pressed into this counterbore and retained within the top sub. The bearing subassembly 20 includes an upper race 22, a lower race 24 and spherical bearing elements 26 located therebetween to enable the lower race to undergo movement relative to the upper race.

Figure 6:
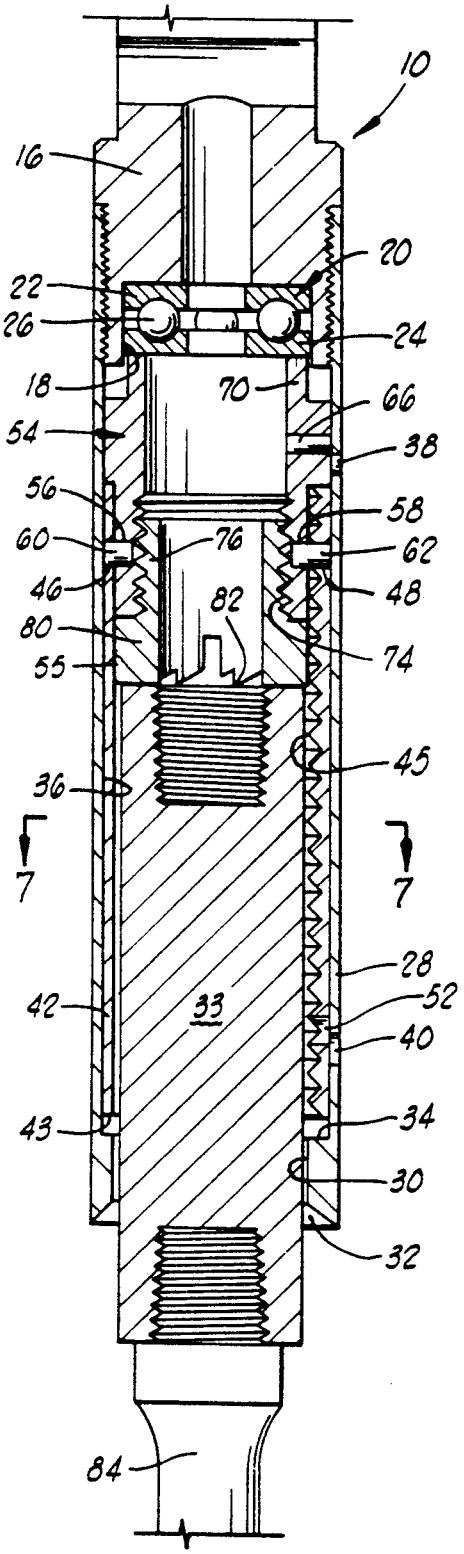
FIG. 6 is a sectional view similar to FIG. 1, but illustrating the lower end portion of the fishing tool when it has been extended over a sucker rod coupling preparatory to engaging the coupling and unscrewing it from that part of the sucker rod string to which it is connected at the lower end.
Figure 7:
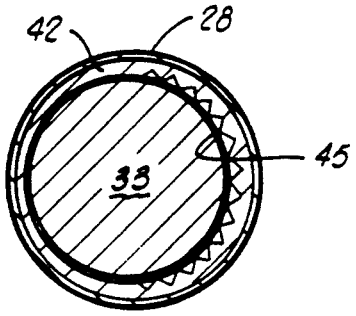
FIG. 7 is a sectional view along line 7—7 of FIG. 6.

An elongated cylindrical slip bowl 28 has an internally threaded upper end portion 29 which threads over and engages the externally threaded bottom portion 15 of the top sub 10. As shown in FIG. 1, the slip bowl 28 is provided with an axially offset bore 30 in its lower end, and has a tapered lead-in surface 32 at this lower end to lead the upper portion of a sucker rod coupling 33 (see FIG. 6) to be retrieved into the interior of the lower end of the slip bowl. In a typical construction, the slip bowl 28 has an outside diameter of about $1\frac{7}{8}$ inches and the tool can typically be run inside $2\frac{3}{8}$ inch outside diameter tubing with an inside drift diameter of 1.9 inches. The offset bore 30 at the lower end of the slip bowl 28 may have a typical inside diameter of about $1\frac{5}{8}$ inch, with the axial offset of the center of the bore 30 from the longitudinal axis of the slip bowl being about $\frac{5}{8}$ inch.

At the upper end of the offset bore 30, an internal upwardly facing shoulder 34 is formed within the slip bowl and defines the lower end of an axially extending counterbore 36. It is axially centered within the slip bowl, or, stated differently, is centered within the slip bowl so as to cause the upwardly facing shoulder to be radially thicker on one side thereof than the other. A pair of drift pin apertures or openings 38 and 40 are formed through the slip bowl 28 to communicate with the cylindrical interior counterbore 36 therewithin, with one drift pin opening 38 located relatively near to the upper end of the slip bowl, and the other drift pin opening 40 located relatively near to the lower end thereof.

Figure 4:
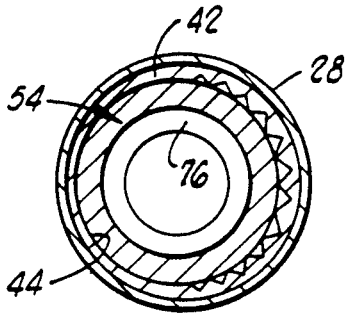
FIG. 4 is a sectional view taken along line 4—4 of FIG. 1.
Figure 5:
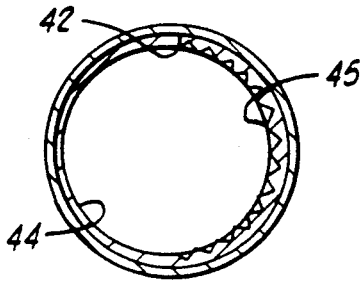
FIG. 5 is a sectional view taken along line 5—5 of FIG. 1.

Carried within the lower end portion of the slip bowl 28 at a location of the counterbore 36 is a cylindrical slip 42. The slip 42 has a lower end 43 which rides upon the upwardly facing shoulder 34. The slip 42 has an offset bore 44 extended therethrough from one end thereof to the other (see FIGS. 4 and 5), and is provided with a cylindrical exterior surface which slidably mates with the internal surface of the slip bowl 28 at the location of the counterbore 36.

The internal cylindrical offset bore 44 of the slip 42 has pyramidal teeth 45 formed thereupon over the total length of the thick portion of the slip—that is, over 180° of the total internal circumferential extent of the offset bore within the slip. Stated yet differently, the pyramidal teeth 45 are cut over ½ of the inside diameter of the slip 42. A pair of opposed drift pin holes 46 and 48 are cut through the slip 42 near the upper end thereof and on diametrically opposite sides of the slip. A third drift pin hole 52 is cut through the slip near the lower end thereof at a position to facilitate registry of this drift pin hole with the lower drift pin opening 40 through the slip bowl as hereinbefore described.

A generally cylindrical slip guide 54 has a lower end portion which has an outer cylindrical surface 55 offset with respect to the longitudinal axes of the slip bowl 28 and of the top sub 10 so as to be able to receive and mate with the slip 42 when the offset cylindrical bore 44 of the slip is pressed over the cylindrical outer surface on the slip guide. A pair of opposed roll pin holes 56 and 58 are formed in the slip guide 54 at a point where the roll pin holes are aligned with the opposed roll pin holes 46 and 48 through the slip 42. In this way, a pair of roll pins 60 and 62 can be extended through the aligned roll pin holes in the slip and the slip guide to thereby interlock these structural elements against relative rotational movement, and assure that, as the tool is operated, these two structure remain rotatively fixed to each other.

Near its upper end portion, the slip guide 54 carries an outer cylindrical surface 63 which has a diameter which matches the inside diameter of the slip bowl 28 at this location. The slip guide 54 is not, however, pressed tightly into the slip bowl 28 since, during the use of the tool as hereinafter described, the slip bowl is required to rotate relative to the slip guide. A temporary interlock is provided between the two, however, by providing a shear pin opening 66 in the upper end portion of the slip guide 54 at a location, where it is in alignment with the upper drift pin opening 38 provided in the upper portion of the slip bowl 28. A shear pin 68 is then used to interlock the slip bowl 28 to the slip guide 54 until the shear pin is sheared during the use of the tool as hereinafter described. A cylindrical neck 70 at the upper end of the slip guide 54 is dimensioned to be able to pass into the counterbore 18, and contact the lower side of the lower race 24 of the bearing 20. The ability of the slip guide 54 to move upwardly within the slip bowl 28 is realized after the pin 68 has been sheared during operation of the tool in a manner hereinafter described.

At its lower end, the slip guide 54 is provided with a threaded internal bore 74 which is dimensioned to receive an externally threaded neck 76 carried on the upper end of a selected spacer 80. The spacer 80, which is externally threaded for threaded engagement with the slip guide 54, has a length which is selected so that, when the fishing tool is lowered in the production tubing and the lower end thereof is passed over a coupling or other structure to be retrieved, the coupling can then pass up within the slip 42 to a location where the upper end of the coupling will come in contact with a plurality of downwardly extending teeth 82 which are formed on the lower end of the spacer so. The outside diameter of the spacer 80 is, of course, sufficiently small that the spacer is able to project downwardly inside the slip 42 by a distance which depends upon the length of the spacer which has been selected. The distance which the spacer needs to project downwardly is susceptible to calculation on the basis of distance measurements to the coupling to be retrieved as measured from the surface downwardly in the well bore.

OPERATION

In the use of the fishing tool of the invention, the tool is lowered into a production tubing in which the lower portion of the disconnected sucker rod string is located. Such sucker rod string carries at its upper end, an entire, or a part of, a coupling 33 of the type used to couple two sections of sucker rod to each other. The coupling 33 can exist in this state by reason of having become uncoupled from the next upwardly located sucker rod section, or by reason of fracture or failure of the coupling intermediate its length.

It is the objective to unscrew the coupling and retrieve it from the hole, and it is to this end and purpose that the fishing tool of the present invention is directed. The fishing tool has been made up at the surface in the form and arrangement shown in FIG. 1. The spacer 80 has been selected to be of a length such that it can project a sufficient distance down inside the slip 42 that the teeth 82 carried on the lower end of the spacer can bight into, and engage, the upper end of the sucker rod coupling at a time when the top of the cylindrical neck 70 carried at the upper end of the slip guide 54 has passed upwardly and comes in contact with the lower race 24 of the bearing 20.

As the fishing tool continues to pass downwardly into the production tubing, it is then set down upon the sucker rod coupling 33. The coupling 33 passes through the open lower end of the slip bowl 28, being guided through this opening by the lead-in surface 32. The upper end of the sucker rod coupling 33 continues to move relatively upwardly inside the fishing tool, moving upwardly within the hollow interior of the slip 42 which, at this time, is pinned in essentially the position which is shown in FIG. 1. This position of the slip 42 has been attained by pre-alignment with the slip bowl 28 through the use of an alignment pin inserted through the pin openings 40 and 52 located in the lower end of the slip bowl 28 and the lower end of the slip 42, respectively, as hereinbefore described. After such alignment has been achieved, the alignment pin is then removed so that, at this time, the slip bowl 28 will not be restricted in its rotative movement relative to the slip 42 by the alignment pin.

Downward movement of the tool over the coupling 33 continues until the top of the coupling comes in contact with the teeth 82 carried on the lower end of the spacer 80. As the string which carries the fishing tool on the lower end thereof continues to be lowered and then forced downwardly from the surface, the shear pin 68 is sheared by bumping the spacer against the coupling. This forces the spacer 80 and the slip guide 54 connected thereto upwardly relative to the downwardly moving fishing tool.

With the pin 68 sheared, and the neck portion 70 of the slip guide 54 moves upwardly into contact with the lower race 24 of the bearing 20 (which status can be determined by sensing tool movement and resistance to movement encountered at the surface), the tool is ready to be subjected to rotative movement for the purpose of releasing the coupling 33 from the sucker rod string 84 therebelow to which it is threaded. The tool string is rotated in a counterclockwise direction, and due to the counterclockwise construction of the threads by which the slip bowl is engaged with the top sub, as well as of the thread by which the spacer is engaged with the slip guide 54, the slip bowl 28 is rotated relative to the slip 42.

Figure 8:
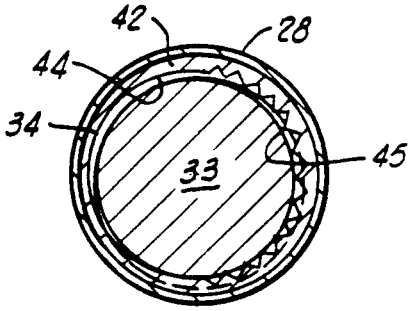
FIG. 8 is a sectional view similar to FIG. 7, but showing a different operative relationship of a tubular slip bowl and a generally cylindrical or tubular slip constituting structural elements forming a part of the fishing tool of the present invention.

I will be understood that the slip 42 is retained stationary because the slip 42 is pinned to the slip guide 54 by pins 60 and 62, and the slip guide is, in turn, connected to the spacer 80 by counterclockwise threaded (left-hand threaded) threads. Moreover, the teeth 82 are biting into the top of the coupling 33 (see FIG. 6) and this also retains the slip 42 stationary at this time relative to the coupling 33. As the slip bowl 28 commences to rotate in a counterclockwise direction relative to the slip 42, which remains stationary at this time, the offset counterbore 30 in the slip bowl is moved through about 90° relative to the offset bore 44 in the slip. This results in a convergence of the internal surfaces of the slip and slip bowl upon the cylindrical outside surface of the coupling. The result is a gripping of the coupling 33 by the slip 42 and slip bowl 28. This convergence of the internal surfaces of the slip bowl and slip upon the external cylindrical surface of the coupling causes the pyramidal teeth 45 on the internal surface of the slip 42 to bight into the coupling so that it becomes firmly engaged (see FIG. 8) and, with further rotation of the tool string 14, is forced to undergo concurrent counterclockwise rotation. Continued counterclockwise rotation of the tool string thus ultimately causes the sucker rod coupling 33 to be disconnected from the sucker rod section 84. The coupling can then be extricated from the well bore simply by retrieving the fishing tool and the coupling gripped thereby.

From the foregoing description of a preferred embodiment of the downhole fishing tool of the invention, it will be perceived that various dimensional changes and structural rearrangements can be made in the illustrated and described structure without departure from the basic principles which underlie the invention. Changes and innovations of this type are therefor deemed to be circumscribed by the spirit and scope of the invention, except as the same may be necessarily limited by the appended claims or reasonable equivalents thereof.

What is claimed is:

1. A downhole fishing tool for removing a structure from downhole in a well comprising:

a tool string;

a generally cylindrical top sub having a lower end, an externally threaded upper end adapted for threaded engagement with a lower end of said tool string, and a longitudinal axis extending through the upper and lower ends;

a tubular slip bowl having an upper end portion internally threaded and threadedly engaging the lower end of said top sub, an open lower end, and a longitudinal axis extending through the upper end portion and lower end, said slip bowl having an axially offset cylindrical bore in the open lower end thereof offset from the longitudinal axes of said slip bowl and the generally cylindrical top sub;

an elongated tubular slip positioned within said slip bowl and rotatable relative to said slip bowl and having an upper end and a lower end, said slip having an axially offset bore extending upwardly thereinto from the lower end thereof so that the axially offset cylindrical bore of said slip bowl may be rotated with respect to the offset bore in said slip by rotation of said slip bowl about said slip during operation of the fishing tool;

cylindrical slip guide means having:

an external cylindrical surface slidingly and rotatably bearing against the interior of the upper end portion of said slip bowl;

a lower end portion having an external surface telescoped into the upper end of said elongated tubular slip and connected to said slip for mutual rotation therewith relative to said slip bowl; and axially extending structure-engaging teeth carried on the lower end portion of said cylindrical slip guide means for engaging the upper end of a structure to be removed from the well by the use of the fishing tool when said tool is lowered to pass both said slip and said slip bowl over and around said structure.

2. A downhole fishing tool as defined in claim 1 wherein said slip guide means comprises:

a slip guide element connected to said slip; and a spacer element detachably engaged with said slip guide element and projecting downwardly therefrom, said spacer element being further characterized as including said axially projecting teeth on a lower end thereof adapted for engagement with the structure to be extricated from the well by the use of said fishing tool.

3. A downhole fishing tool as defined in claim 1 wherein said top sub has a cylindrical bore in the lower end thereof, and wherein said fishing tool is further characterized as including a bearing element positioned in the bore in the lower end of said top sub.

4. A downhole fishing tool as defined in claim 3 wherein said slip guide means comprises:

a slip guide element connected to said slip; and a spacer element detachably engaged with said slip guide element and projecting downwardly therefrom, said spacer element being further characterized as including said axially projecting teeth on a lower end thereof adapted for engagement with the structure to be extricated from the well by the use of said fishing tool.

5. A downhole fishing tool as defined in claim 1 wherein said offset cylindrical bore in the open lower end of said tubular slip bowl is of smaller diameter than the outer diameter of said elongated tubular slip, and said slip is positioned in a counterbore located within said slip bowl at a position above said axially offset cylindrical offset bore in the open lower end thereof, and wherein the lower end of said slip bowl is further characterized in including, a supporting shoulder for supporting said tubular slip in said counterbore so that said elongated tubular slip can undergo rotation with respect to said slip bowl while the lower end of said slip is supported on said shoulder.

6. A downhole fishing tool connectable to a lower end of a tool string for removing a structure from downhole in a well bore comprising:

an elongated, generally cylindrical top sub having a lower end and an upper end adapted for engagement with a lower end of the tool string and used for transferring control movements form the tool string to said fishing tool, said top sub having a longitudinal axis extending between the upper end and lower end;

a tubular slip bowl having a threaded upper end portion, having an open lower end, having a generally cylindrical outer surface, and having a longitudinal axis aligned with the longitudinal axis of the top sub, said tubular slip bowl threadedly engaging the lower end of said top sub and having a structure-receiving bore in the lower end thereof, said structure-receiving bore having a first portion thereof located at a first radial distance from said longitudinal axes of said tubular slip bowl and the generally cylindrical top sub to which said slip bowl is threadedly connected, said structure-receiving bore further having a second portion located a second radial distance from said longitudinal axes of said tubular slip bowl and said generally cylindrical top sub, with said second radial distance being less than said first radial distance, said slip bowl further being characterized by having an upwardly extending counterbore of cylindrical configuration located concentrically relative to the outer cylindrical surface of said slip bowl, and positioned above said structure-receiving bore in the lower end of said slip bowl;

an elongated tubular slip having an upper end and a lower end and positioned within said slip bowl in said counterbore for rotation relative to said slip bowl, said slip having an axially offset bore extending upwardly thereinto from the lower end thereof so that said structure-receiving bore of said slip bowl may be rotated with respect to the offset bore in said slip by rotating said slip bowl about said slip during operation of the fishing tool whereby an object to be retrieved by the fishing tool can be gripped between the structure-receiving bore of said slip bowl and the offset bore of said slip in the course of said relative rotation between said slip bowl and slip;

a cylindrical slip guide means having:

an external cylindrical surface slidingly and rotatingly bearing against the interior of the upper end portion of said slip bowl;

a lower end portion having an external surface telescoped into the upper end of said elongated tubular slip and connected to said slip for mutual rotation therewith relative to said slip bowl; and means on the lower end portion of said cylindrical slip guide means for engaging the upper end portion of a structure to be removed from the well bore by the use of the fishing tool when said tool is lowered to pass both said slip and slip bowl over and around said structure.

* * * * *